US006074713A

United States Patent [19]

Trotter, Jr.

[11] Patent Number: 6,074,713

[45] Date of Patent: Jun. 13, 2000

[54] PREVENTING CARBON DEPOSITS ON METAL

[75] Inventor: Donald M. Trotter, Jr., Newfield, N.Y.

[73] Assignee: Corning Incorporated, Corning, N.Y.

[21] Appl. No.: 08/979,089

[22] Filed: Nov. 26, 1997

Related U.S. Application Data

[63] Continuation-in-part of application No. 08/427,338, Apr. 24, 1995, Pat. No. 5,807,616.

[51] Int. Cl.[7] ..... B32B 17/00

[52] U.S. Cl. ..... 428/34.4; 428/34.6; 428/471; 428/472; 428/701; 428/702; 427/372.2; 427/376.2; 427/376.4; 427/383.5

[58] Field of Search ..... 428/34.4, 34.6, 428/446, 450, 471, 472, 701, 702; 138/143, 147; 427/372.2, 376.2, 376.4, 383.5

[56] References Cited

U.S. PATENT DOCUMENTS

| | | | |
|---|---|---|---|
| 3,368,712 | 2/1968 | Sanford et al. . | |
| 3,397,076 | 8/1968 | Little et al. . | |
| 3,597,241 | 8/1971 | Perugini . | |
| 3,719,519 | 3/1973 | Perugini . | |
| 4,099,990 | 7/1978 | Brown et al. . | |
| 4,724,064 | 2/1988 | Reid . | |
| 5,208,069 | 5/1993 | Clark et al. . | |
| 5,250,360 | 10/1993 | Andrus et al. . | |
| 5,269,137 | 12/1993 | Edwards, III . | |
| 5,298,332 | 3/1994 | Andrus et al. . | |
| 5,807,616 | 9/1998 | Trotter | 428/34.4 |

FOREIGN PATENT DOCUMENTS

| | | |
|---|---|---|
| 0 608 081 A1 | 7/1994 | European Pat. Off. . |
| 1199483 | 7/1970 | United Kingdom . |
| 1604604 | 12/1981 | United Kingdom . |

*Primary Examiner*—Timothy M. Speer
*Attorney, Agent, or Firm*—Milton M. Peterson

[57] ABSTRACT

A method of lessening the tendency of carbon to deposit on a hot metal surface, particularly a component in a furnace for thermally cracking hydrocarbons, that comprises coating a chromium-containing metal surface with a layer of porous, dry, pulverized glass and heating the coated metal to form an adherent, vitreous coating on the metal surface.

29 Claims, 3 Drawing Sheets

Fig. 3
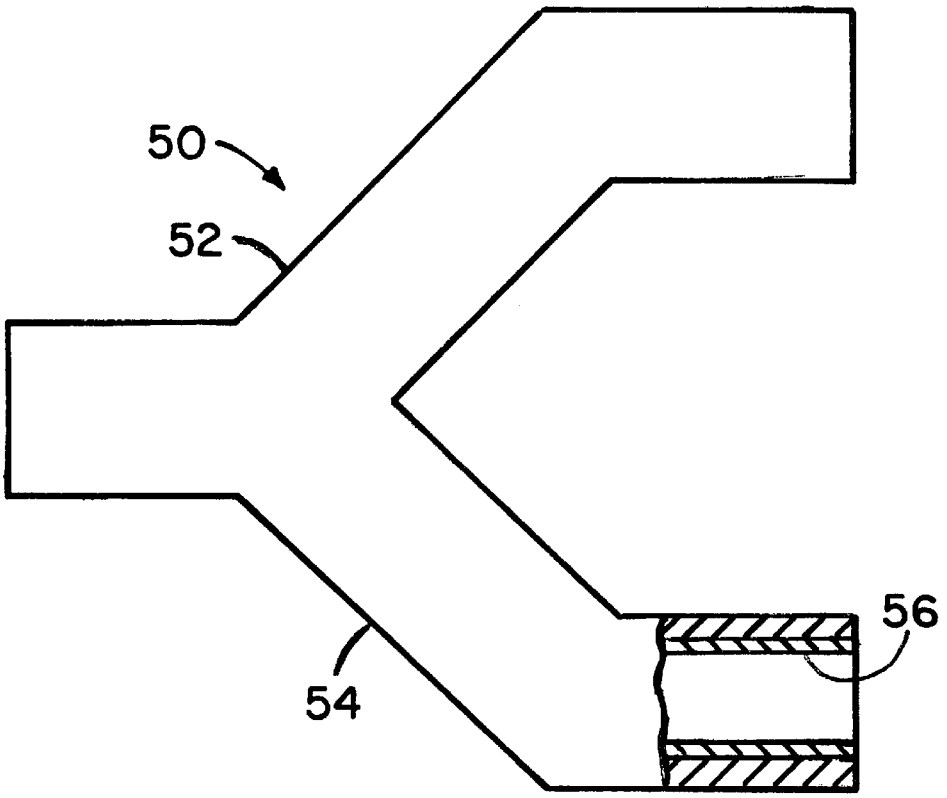
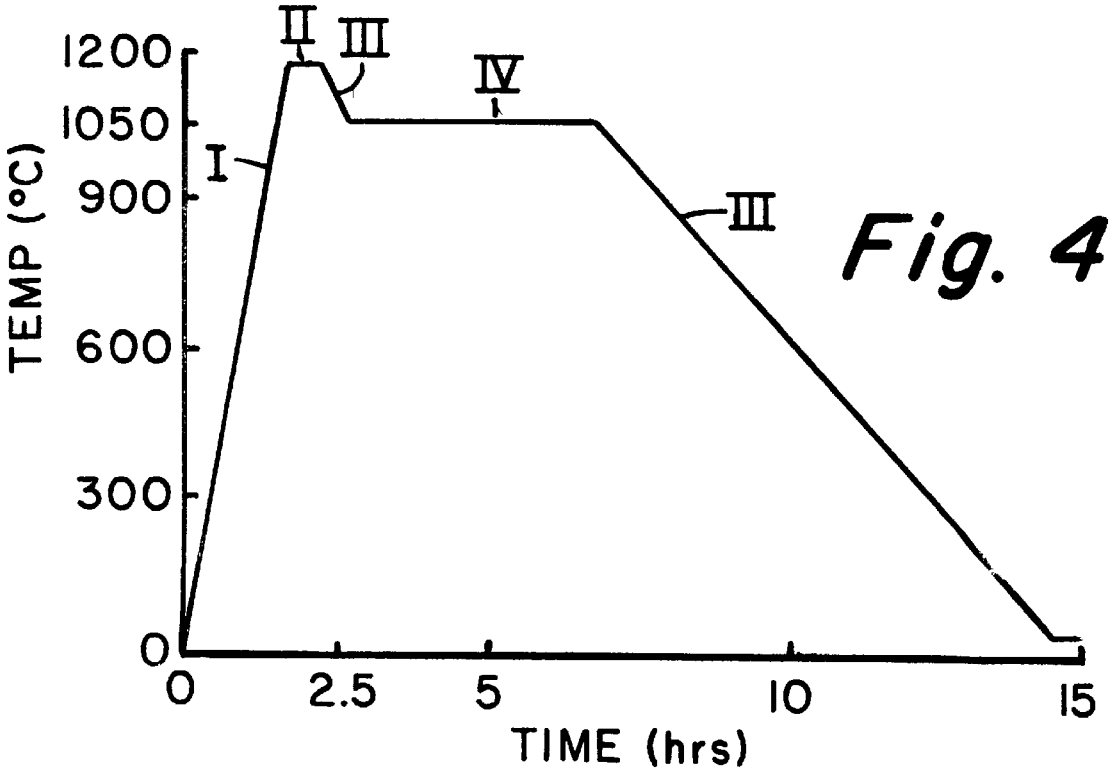
Fig. 4

PREVENTING CARBON DEPOSITS ON METAL

This application is a continuation-in-part of Ser. No. 08/427,338 that application having been, filed Apr. 24, 1995 and issued as U.S. Pat. No. 5,807,616 on Sep. 15, 1998.

FIELD OF THE INVENTION

Method of coating a metal surface to prevent carbon depositing on that surface when the metal is exposed to a source of carbon while the metal is heated, and the coated metal article.

BACKGROUND OF THE INVENTION

The tendency for carbon to deposit on certain hot metal alloy surfaces is well recognized. It is also known that such carbon deposits can adversely affect metal properties, e.g., by embrittlement of the metal. Also, carbon deposits can impede certain operations that employ heated metal processing equipment. One such operation is thermal cracking of alkane hydrocarbons to form olefins (alkenes) in the petrochemical industry.

At the heart of a thermal cracking process is the pyrolysis furnace. This furnace comprises a fire box through which runs a serpentine array of tubing. This array is composed of lengths of tubing and fittings that may total several hundred meters in length. The array of tubing is heated to a carefully monitored temperature by the fire box.

A stream of feedstock is forced through the heated tubing under pressure and at a high velocity, and the product quenched as it exits. For olefin production, the feedstock is frequently diluted with steam. The mixture is passed through the tubing array which is commonly operated at a temperature greater than 750° C. During this passage, a carboniferous residue is formed and deposits on the tube walls and fittings.

The problem of carbon deposits forming during the thermal cracking of hydrocarbons is one of long standing. It results in restricted flow of the gaseous stream of reaction material. It also reduces heat transfer through the tube wall to the gaseous stream. The temperature to which the tube is heated must then be raised to maintain a constant temperature in the stream flowing through the tube. This not only reduces process efficiency, but ultimately requires a temperature too high for equipment viability, as well as for safety requirements. A shutdown then becomes necessary to remove the carbon formation, a process known as decoking.

Numerous solutions to the problem of coking have been proposed. One such solution involves producing metal alloys having special compositions. Another proposed solution involves coating the interior wall of the tubing with a silicon-containing coating, such as silica, silicon carbide, or silicon nitride. In still another proposal, the interior wall of the tubing is treated with an aluminum compound. This process involves aluminum surface conversion as well as diffusion into the metal. It has also been proposed to introduce additives, such as sulfides, to the feedstock stream.

Despite these numerous proposals, the problem still remains. It is then a basic purpose of the present invention to provide an effective solution to the problem.

In a broader sense, a purpose of the invention is to provide a method of reducing the tendency for carbon to deposit on a metal surface.

SUMMARY OF THE INVENTION

The invention resides in a method of lessening the tendency for carbon to deposit on a hot metal surface, when that surface is exposed to a source of carbon, the method comprising coating a surface on a high temperature, metal alloy containing chromium with a porous, dry layer of pulverized glass, heating the coated metal in an atmosphere containing oxygen to oxidize chromium at the coating interface, thermally sintering and softening the glass powder coating, dissolving the chromium oxide in the glass, forming an adherent, vitreous coating on the metal surface and cooling the coated article.

Specific embodiments of the invention reside in a method of producing an element for a thermal cracking furnace that is exposed to a stream of gaseous hydrocarbons at a thermal cracking temperature, and in coated elements for a thermal cracking furnace.

PRIOR ART

Prior literature of possible interest is listed in an accompanying document.

BRIEF DESCRIPTION OF THE DRAWINGS

FIG. 3 is a front elevation view, partly broken away, showing a furnace fitting in accordance with the invention.

FIG. 4 in the accompanying drawing, is a graphical representation showing a typical time-temperature cycle for carrying out the method of the present invention.

DESCRIPTION OF THE INVENTION

Figure 1:
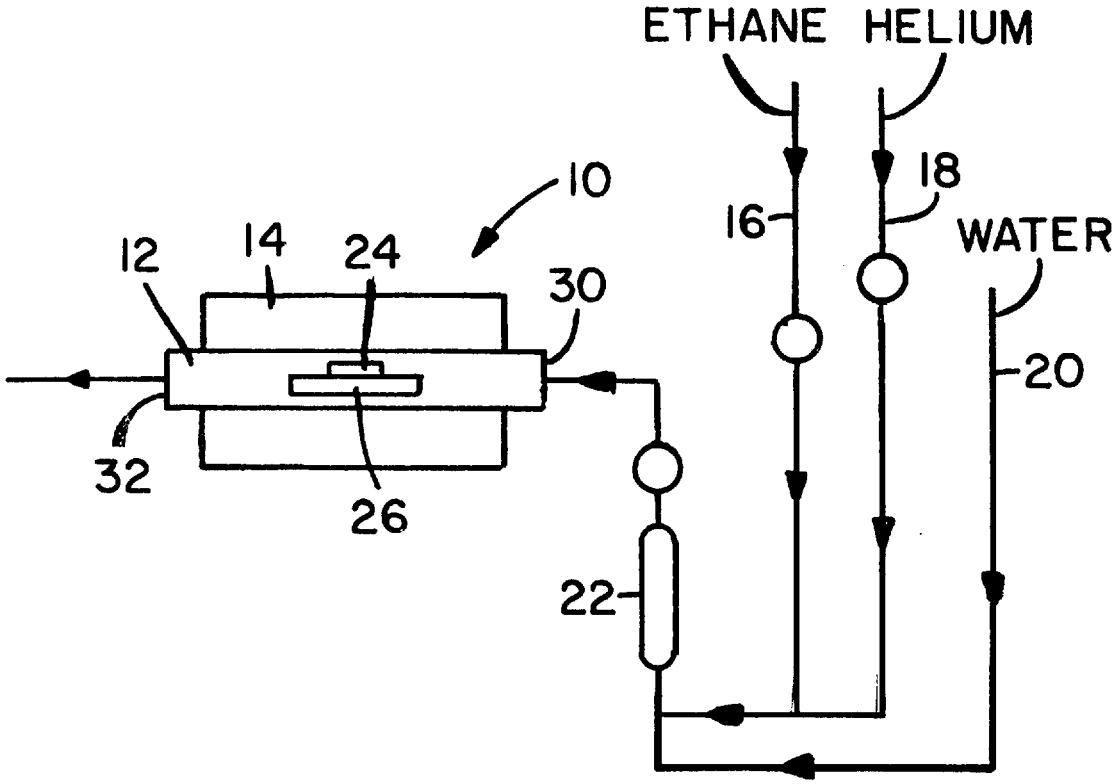
FIG. 1 is a schematic side view of an apparatus suitable for performing tests described herein.

Practice of the inventive method requires applying a thin coating of glass on a metal surface to be protected from carbon deposition. The glass is prepared in particulate form by pulverizing glass fragments. The fragments may be obtained, for example, by dri-gaging a stream of molten glass, that is, running the stream into water to chill and fracture it into small fragments. Alternatively, a thin sheet or ribbon of glass may be quenched by rolling and breaking into fragments. The fragments are then milled, or otherwise reduced, to a desired average particle size which may be on the order of 8 microns.

The glass particle size is critical to the extent that a coating, when dry, must be of a porous nature. It must also sinter and soften to a continuous glassy layer during the thermal processing. The coating must be sufficiently porous to permit ready access by oxygen to the coated metal surface for a reason to become apparent. The degree of porosity is not critical, but a porosity of about 60% by volume has been found to be quite satisfactory.

The glass, in particulate form, may be applied dry by any convenient application procedure. On large surfaces, such as the interior of cracking furnace tubes, it has been found convenient to apply a slurry produced by mixing the glass with a suitable vehicle. The slurry may then be applied to the interior surface of a tube by drawing a spray applicator through the length of the tube while the tube is being rotated. Alternatively, the spray applicator may be rotated while the tube remains at rest. When applied as a slurry, the coating must be dried to form a completely dry, porous coating on the metal surface.

Coating thickness is not critical. In theory, the coating need only be of sufficient thickness to form a continuous, chromium-containing, glassy layer on the metal surface. This layer may be on the order of 5–10 microns thick. However, it may be difficult and expensive to produce such a thin coating that is continuous and uniformly thick on the inside of a large tube. Therefore, it has been found convenient, in coating cracking furnace tubes, to apply a layer of sufficient thickness to provide an ultimate fired coating ranging up to 0.250 mm. in thickness.

The metal body may be any high-temperature alloy having an appreciable content of chromium in its composition. The inventive method has been developed using iron-nickel-chromium alloys of the type commonly used in hydrocarbon-cracking furnaces. One such alloy, for example, is designated HK-45 indicating a carbon content of about 0.45%. This alloy is constituted of about 37% iron, 35% nickel and 27% chromium. As explained later, a key ingredient in this alloy for present purposes, is the chromium. However, the chromium level need not be that high, an amount on the order of 10% or less being adequate to form an adherent glass layer in conjunction with the coating.

Any glass that softens at a sufficiently high temperature may be employed. The alkaline earth metal borates and borosilicates and alkaline earth metal silicates are particularly suitable. In general, alkali metal silicates and aluminosilicates are unsuitable due to physical and/or chemical property incompatibility. This includes low coefficients of thermal expansion and low softening temperatures.

For use in a hydrocarbon thermal cracking process, a preferred coating is a barium aluminosilicate or strontium-nickel aluminosilicate glass. The barium aluminosilicate will have primary crystal phases of sanbornite and cristobalite and a minor phase of $BaAl_2Si_2O_8$, when crystallized. It will contain 20–65% BaO, 25–65% $SiO_2$ and up to 15% $Al_2O_3$. The strontium-nickel aluminosilicate, when crystallized, will contain primary crystal phases of $SrSiO_3$ and $Ni_2SiO_4$, a minor phase of cristobalite. It will contain 20–60% SrO, 30–70% $SiO_2$, up to 15% $Al_2O_3$ and up to 25% NiO. Glasses having compositions 14 and 12, respectively, in TABLE I are presently preferred.

TABLE I sets forth, in weight percent on an oxide basis as calculated from the glass batch, the compositions for several different glasses having properties that adapt them to use for present purposes. Examples 1–6 illustrate alkaline earth metal alumino borates or borosilicates. Examples 7–14 illustrate alkaline earth metal silicates which may contain minor amounts of alumina or zirconia.

FIG. 1 is a schematic representation of an apparatus designed for experimental testing and generally designated by the numeral 10. Coating material candidates were tested either in the form of solid bodies or as coatings. Coatings were applied to metal coupons, e.g. HP-45 alloy, cut from lengths of metal tubing cast for pyrolysis furnace use. The coupons were coated with the precursor glass in frit form. Slurries were prepared from glass frits having the exemplary compositions 10, 12 and 14. The slurries were applied to the metal coupons by either spraying the slurry, or by repeatedly dipping the coupon in the slurry. The coating was then dried. Dry glass powders having the compositions of examples 4 and 7 were applied by electrostatic spraying.

Each dried coating was then fired to sinter the glass and convert it to a glass-ceramic state. A ceramming schedule appropriate for each glass was employed.

Apparatus 10 comprises a quartz reactor tube 12 positioned in an electrically heated furnace 14. A feedstock stream was provided to reactor tube 12 by mixing ethane from a source 16 with a carrier gas, helium, from a source 18 and water from a source 20. Each source was provided with valves and controllers (not shown). The mixture was passed through a steam generator 22 to generate a gaseous mixture that was discharged into reactor tube 12.

In carrying out a test, a test sample 24 was placed on a quartz holder 26 and inserted in the heated tube 12. Reactor tube 12 was a quartz tube 90 cm in length and 4 cm in diameter. It was positioned in furnace 16, and was provided with a sealed entry 30 and a sealed exit 32.

Furnace 14 was designed to heat samples to temperatures in the range of 600–900° C. With the furnace at temperature and a sample in place, a mixture of ethane and steam, in a 4:1 volume ratio, was introduced into tube 12 at entry 30.

Samples of the gaseous product were withdrawn at regular intervals at exit 32. At the completion of each reaction, the sample was cooled to room temperature, and the amount of carbon formed on the test sample was determined by weight difference.

Tests were carried out at a temperature of 850° C. for progressively increasing periods of testing time. In these tests, the ethane-steam mixture was passed through the furnace in the presence of uncoated HP-45 alloy samples to establish an appropriate period of test time. TABLE II presents the results of these tests with time shown in hours; and the weight gains (coke accumulation) in grams.

TABLE I

| | $SiO_2$ | $B_2O_3$ | $Al_2O_3$ | BaO | MgO | CaO | ZnO | $ZrO_2$ | $MnO_2$ | SrO | NiO | F |
|---|---|---|---|---|---|---|---|---|---|---|---|---|
| 1 | — | 19.1 | 27.9 | 42.0 | 11.0 | — | — | — | — | — | — | — |
| 2 | — | 25.4 | 18.6 | 56.0 | — | — | — | — | — | — | — | 6 |
| 3 | 17.5 | 20.2 | 29.7 | — | — | 32.6 | — | — | — | — | — | — |
| 4 | 9.6 | 22.2 | 32.5 | — | — | 35.8 | — | — | — | — | — | — |
| 5 | 30.6 | 12.7 | 3.8 | 15.9 | 23.5 | — | 13.5 | — | — | — | — | — |
| 6 | — | 27.0 | 19.8 | 29.7 | 7.8 | — | 15.8 | — | — | — | — | — |
| 7 | 32.0 | — | — | 40.9 | — | — | — | 8.2 | 18.9 | — | — | — |
| 8 | 33.9 | — | 2.9 | 43.3 | — | — | — | — | 20.0 | — | — | — |
| 9 | 33.2 | 4.8 | — | 42.4 | — | — | — | — | 19.6 | — | — | — |
| 10 | 65.0 | — | 6.9 | — | — | — | — | — | — | 28.1 | — | — |
| 11 | 47.2 | — | — | — | — | — | — | 12.1 | — | 40.7 | — | — |
| 12 | 54.1 | — | 5.7 | — | — | — | — | — | — | 23.3 | 16.8 | — |
| 13 | 38.3 | — | — | — | — | — | — | 5.9 | 22.7 | 33.1 | — | — |
| 14 | 62.7 | — | 5.3 | 32.0 | — | — | — | — | — | — | — | — |

TABLE II

| Time (hours) | 2 | 4 | 7 | 13 |
|---|---|---|---|---|
| Wt. Gain/grams | 0.0346 | 0.0502 | 0.0747 | 0.0843 |

The data indicated that progressively increasing amounts of carbon were deposited with time, but that the rate was slower above 7 hours. Accordingly, comparative material runs were made for a period of 7 hours with the furnace temperature at 850° C.

Comparative tests were made on samples prepared as coatings on 5 cm (2") long coupons of an Fe—Cr—Ni alloy containing 0.45% carbon (HP-45 alloy). The metal pieces were cut from a pyrolysis furnace tube. To guard against pin holes, the coatings had a thickness of at least about 0.0375 mm (1.5 mils). Much thicker coatings may be employed, but no advantage is seen. During each test, carbon deposition was determined by weight difference of the sample.

TABLE III shows, in grams, the comparable amounts of carbon deposited in seven hour test periods on test pieces employing five (5) compositions set forth in TABLE I; also, on an uncoated alloy sample and a fused quartz sample used as a standard. The sample numbers in TABLE III correspond to the composition numbers in TABLE I.

TABLE III

| Sample | Weight (grams) |
|---|---|
| 10 | 0.0032 |
| 12 | 0.0005 |
| 4 | 0.0028 |
| 7 | 0.0016 |
| 14 | 0.000 |
| Uncoated | 0.0747 |
| Quartz | 0.000 |

It is readily apparent that the rate of coke formation on the test piece coatings was comparable to that on fused quartz, and a magnitude less than that on uncoated metal.

Successful tests led to determining compatibility and effectiveness of coatings on austenitic cast alloys of the type used in cracking furnace tubes. Such tubes are on the order of 10 cm (4") diameter and several meters in length. Accordingly, tests were made on coupons which were cut from lengths of commercial tubing and were 5 cm (2") in length and 1.2–2.5 cm (½–1") wide.

Test samples were cut from pipes of three commercial Fe—Cr—Ni alloys: HP-40, HP-45 and HK-40. These alloys contain a minor amount of carbon, indicated in hundredths of a percent by the numeral in the designation, as well as certain other minor alloy constituents.

For test purposes, a kilogram (2 pound) melt of each glass was made in a furnace operating at 1600° C. for four hours. Each melt was dri-gaged, that is, poured into water to quench the glass and cause it to fracture into particles. With subsequent larger melts, the molten glass was quenched by rolling to form a thin fragmented sheet.

To prepare a coating slurry, the broken glass was dry ball milled with alumina media for 8 hours in an alumina container. This reduced the glass to an 8 micron average particle size. Separately, a polybutyl methacrylate binder was mixed with equal parts of ethyl and amyl acetate to form a homogeneous vehicle.

The frit powder, in a ratio of 2.5 grams to 1 gram of binder, was added to the vehicle and rolled with zirconia balls in a plastic container to form a coating slip. Other known binders and vehicles may be employed, the materials and proportions selected being dependent on the coating operation. The coating slip was applied to the coupons by repeatedly dipping the sample in the coating and drying to provide a coating having a thickness of about 200 mg coating/6.5 sq. cm (1 sq. in.).

The coated coupons were then heated to cause the glass frit to soften and flow sufficiently to adhere to the metal. Further heating cerammed the glass, that is, converted it by thermal crystallization to a glass-ceramic. This involved heating the coated samples to 500° C.; holding one hour; heating to 1150° C.; cooling to 1050° C. at furnace rate; holding 4 hours; and cooling to ambient. During this cycle the samples were supported by refractory supports.

Alternatively, the glass can be crystallized (cerammed) by holding at the higher temperature without cooling, but this frequently produces a less desirable crystal pattern.

Adherence of the coating was tested by making a saw cut in the glass-ceramic coated coupon. This test is based on a finding that poorly adhering coatings quickly spall when subjected to a saw cut and then boiling water. The coatings tested were considered to show good adherence.

Service life was tested by thermal cycling. In this test, the coated sample was held for 110 minutes at 850° C. It was then removed from the heating chamber for 10 minutes. During this time, it dropped to a temperature well below red heat. After 24 cycles, the samples were cooled and a portion of the coating removed by partial masking and grit blasting. Then, the partially coated samples were subjected to another 24 cycles. No spalling of the coating occurred on any of the samples tested even after partial coating removal.

To further test endurance of the coating on a small scale, 15 cm (6") coupons were cut from commercial furnace tubing. The coupons were coated, heated to 850° C. and held at that temperature for several weeks in a steam atmosphere. Following this steam treatment, some changes in opacity of the coating were noted. However, the coating remained adherent to the metal and intact.

The effect of particle size of the glass frit was determined by preparing slurries with mean particle sizes of 5.92, 8.25, 18.62 and 26.21 microns. These slurries were applied to test pieces of HP-45 metal tubes and subjected to a thermal cycle. One set was heated to a top temperature of 1150° C.; a second set was heated to a top temperature of 1200° C.

The coatings prepared with the two larger size particles were found inferior to the coatings produced with the smaller particle size material. Based on these tests, a coating material prepared with a glass frit having a mean particle size not over about 10 microns is preferred.

Figure 2:
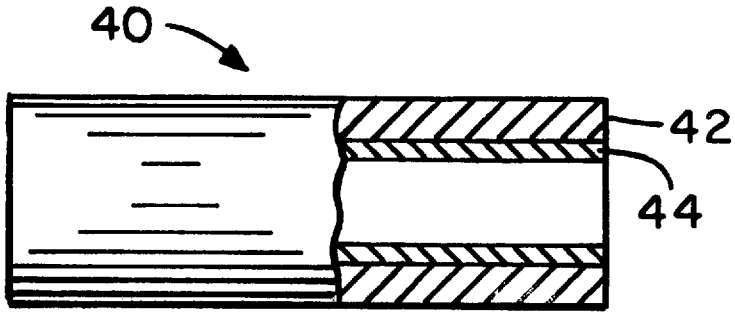
FIG. 2 is a front elevation view, partly broken away, showing a segment of a reactor tube in accordance with the invention.

FIG. 2 is a front elevation view, partly broken away, of a segment 40 of a commercial reactor tube. Such a commercial tube may be up to 12 meters (40 ft.) in length and have a diameter of 2.5–20 cm (1"–8"). Segment 40 comprises a cast alloy tube 42 having a coating 44 on its inner surface. It will be appreciated that a cracking furnace will comprise tubes and fittings, such as elbows, connecting adjacent lengths of tubing. It is contemplated that a complete cracking furnace, including tubes and fittings, will be coated in accordance with the invention. However, short lengths of tubing may be coated and joined, as by welding.

FIG. 3 is also a front elevation view partly broken away. It shows a typical fitting 50 designed to be installed between tube lengths. Fitting 50 is a branched tube adapted to receive a feed stream from the left hand side. It functions to split the stream into two roughly equal streams which enter branches 52 and 54.

The entire interior wall of fitting 50, including branches 52 and 54, may be coated with coatings 56. This is illustrated in the cutaway portion of branch 54.

It is contemplated that all exposed interior surfaces in a pyrolitic furnace system, both within the firebox and outside, will be coated to lessen coking tendencies. As is well known in the industry, fittings include such diverse elements as branched tube connections, elbows, elbow inserts and transfer line exchanger plates.

Figure 5:
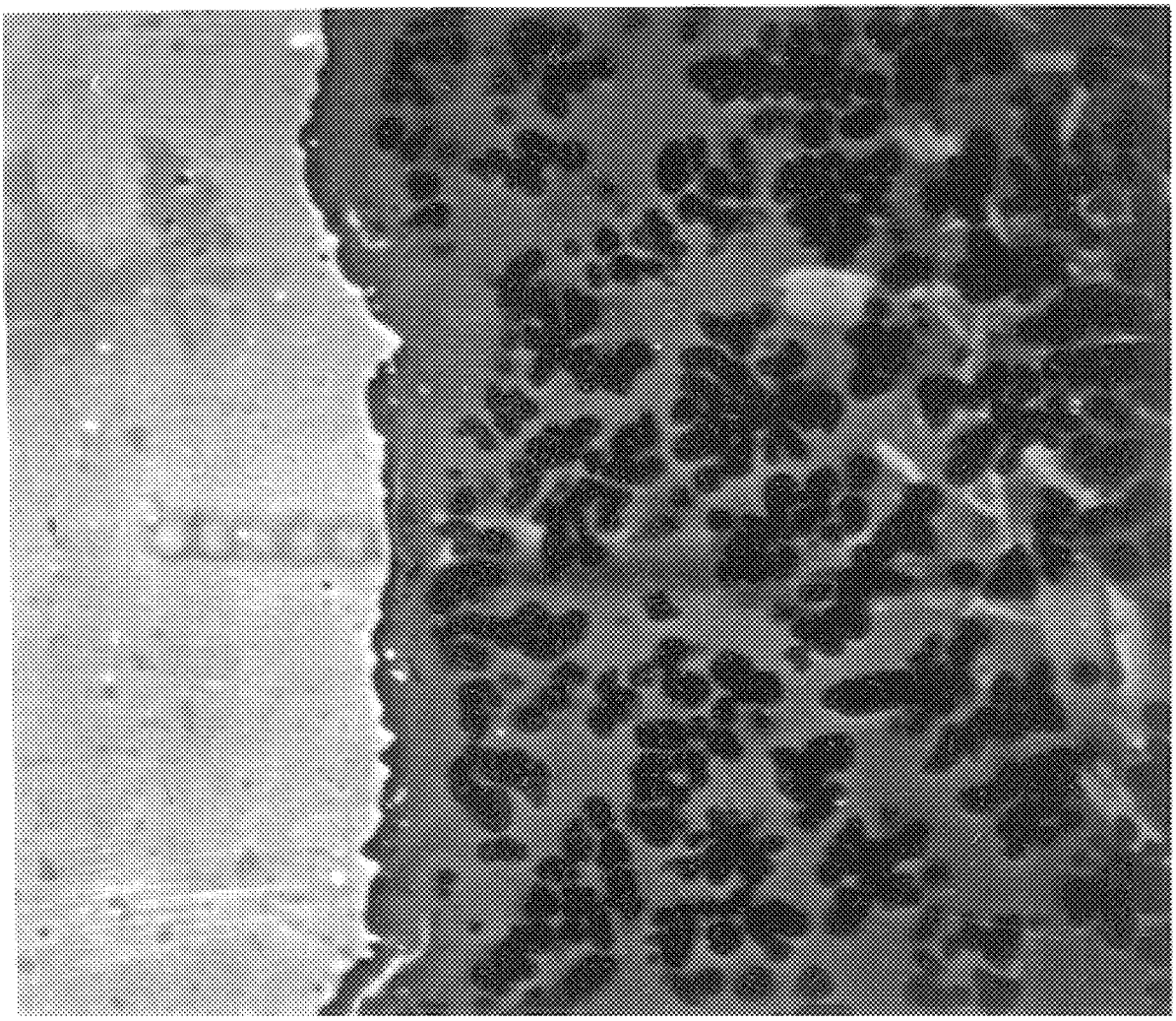
FIG. 5 is a photomicrograph showing a cross-sectional view of a segment of a metal tube coated in accordance with the invention.

The invention is further described with respect to the coating of a length of tubing for a test installation in a commercial furnace. FIGS. 4 and 5 depict the thermal cycle for firing the coating, and the fired product.

A glass having the composition of Example 14 in TABLE I was melted for use in preparing a coating material. The melt was quenched between rollers to produce a thin ribbon that fragmented. The fragmented glass was dry ball milled with alumina media for eight hours in an alumina container.

A slurry was produced by mixing 3200 grams of the glass frit thus produced with 1600 ml. of distilled water, 64 grams of a polyvinyl alcohol binder, and 32 ml. of a surfactant. This mixture was rolled for an hour, and then allowed to age for 24 hours before being applied.

The slurry was applied to the inside surface of a seven foot long tube for installation in a thermal cracking furnace for olefin production from hydrocarbons. The tube was composed of HK-45 alloy containing 27% chromium. The coating was applied to the interior wall of the tube by spraying while the tube was rotating. The coating was then dried to form a porous coating on the tube wall. The dried coating had a thickness equivalent to about 200 mg./6.5 sq. cm. (1 sq. in.), and an estimated porosity of about 60%.

The metal tube with its dry, porous coating of particulate glass was now subjected to a thermal treatment cycle. FIG. 4 in the accompanying drawing depicts a typical cycle. In FIG. 4, temperature is plotted in ° C. on the vertical axis and time in hours is plotted on the horizontal axis.

In stage I, the coated metal is heated in air, while chromium from the metal collects at the coating-metal-air interface, and is oxidized to chromium oxide. During stage II, the porous glass coating softens and forms a continuous, non-porous, vitreaous coating on the metal. In the course of this stage II heating step, the chromium oxide is dissolved in the glass as the glass softens adjacent to the metal surface. The chromium-containing glass forms a thin glass layer on the metal surface that is tenaciously adherent to that surface.

It is evident that the initial coating of particulate glass must be sufficiently porous to permit ready access of oxygen to react with the chromium. Also, the porous nature of the coating must be retained until the chromium migrates to the surface and oxidizes. Hence, the coated tube must be brought up to temperature gradually, a time of about two hours usually sufficing. Once at the top temperature, the coated metal is held for a sufficient time (stage II) to dissolve the chromium oxide and fully wet the metal surface. A time of about thirty minutes has been found sufficient in the coating of furnace tubes.

At this point in the cycle, the coated metal surface may be cooled to ambient temperature (stage III) at furnace rate. It is also apparent that the porous glass coating initially applied need only be of sufficient thickness (10 microns) to form the softened layer that absorbs the chromium oxide. However, it has been found advantageous, in coating tubes for installation in a petrochemical cracking furnace, to apply a thicker coating.

FIG. 5 is a photomicrograph showing a cross-section of a metal tube segment having a relatively thick coating. The photo was taken after a complete thermal cycle. The clear portion at the left of the photo is the metal tube. The relatively thick layer on the right is a portion of the glass that has not absorbed chromium oxide. Intermediate is the thin layer of glass containing absorbed chromium oxide and usually being 5–10 microns thick.

In FIG. 5, the thick portion of the coating on the right has been converted from the glassy state to a glass-ceramic state. This is accomplished by stopping the cooling part of the cycle at the glass crystallization temperature. The coated metal is held at that temperature for a sufficient time, about four hours, to effect crystallization of the glass, thereby changing it to the glass-ceramic state. In FIG. 4, this is indicated as stage IV by a horizontal segment in the cycle curve at about 1050° C.

It will be observed that the glass layer containing chromium oxide does not crystallize, but rather remains glassy. The presence of chromium oxide in the glass inhibits crystallization.

The thicker coating illustrated in FIG. 5 has advantages and disadvantages. It permits greater flexibility in coating, a less expensive application step, and a longer coating life under erosive conditions. However, it does introduce a glass-ceramic layer of different thermal coefficient of expansion from the glass. Also, the thicker coating may have an insulating effect that impedes heat transfer into the gas stream being processed.

Experience indicates two things. First, the expansion differential can result in cracking, and some spalling can occur. However, a substantial amount of the glass-ceramic does remain in place. To the extent that it does, it is observed that carbon deposition is further inhibited by this glass ceramic coating.

We claim:

1. A method of lessening the tendency for carbon to deposit on a hot metal surface when that surface is exposed to a source of carbon, the method comprising coating a surface on a high-temperature metal alloy containing chromium with a porous, dry layer of glass, heating the coated metal in an atmosphere containing oxygen to oxidize the chromium at the coating-metal interface, thermally softening the glass coating, dissolving the chromium oxide in the glass, forming an adherent vitreous coating on the metal surface and cooling the coated article.

2. A method in accordance with claim 1 which comprises using a pulverized glass to coat the surface on the metal alloy, forming a slurry of the pulverized glass, applying the slurry to the metal surface and drying the resulting coating.

3. A method in accordance with claim 1 which comprises coating the metal surface with a layer of glass having a sufficient porosity to permit access of oxygen to the metal surface.

4. A method in accordance with claim 1 which comprises heating the coated metal in air.

5. A method in accordance with claim 1 which comprises coating the metal surface with a layer of a glass selected from a group of glasses consisting of alkaline earth metal silicates, aluminoborosilicates and aluminoborates.

6. A method in accordance with claim 5 which comprises coating the metal surface with a barium aluminosilicate or a strontium-nickel aluminoborosilicate glass.

7. A method in accordance with claim 1 which comprises coating a surface of a high temperature iron-nickel-chromium alloy.

8. A method in accordance with claim 1 which comprises coating the metal surface with a layer of sufficient thickness to form an inner layer of chromium-containing glass on the metal surface and an outer layer of glass that does not contain chromium.

9. A method in accordance with claim 8 which comprises thermally converting the outer layer of glass in the coating to a glass-ceramic.

10. In a method of producing an element for a thermal cracking furnace that is exposed to a stream of gaseous hydrocarbons at a thermal cracking temperature, a method of lessening the tendency for carbon to deposit on an exposed surface of the furnace element which comprises providing a furnace element composed of a high-temperature metal alloy containing chromium, coating an exposed surface on the element with a porous, dry layer of glass, heating the coated element in an oxygen-containing atmosphere, causing chromium to collect at the coating-metal-atmosphere interface, oxidizing the chromium to chromium oxide, thermally softening the glass coating, dissolving the chromium oxide formed at the coating-metal interface in an adjacent portion of the glass, tightly adhering a layer of the chromium-containing glass on the metal surface and cooling the coated element.

11. In a method according to claim 10, the method comprising coating the exposed element surface with a layer of barium aluminosilicate glass having a composition consisting essentially of, in weight percent, 20–65% BaO, 25–65% $SiO_2$ and $Al_2O_3$ in an amount not exceeding 15%.

12. In a method according to claim 10, the method comprising heating the coated element to a temperature of about 1200° C., and holding at that temperature for about thirty minutes to form the tightly adhering, chromium-containing glass layer on the metal element surface.

13. In a method according to claim 10, the method comprising coating the metal element surface with a glass layer of sufficient thickness so that an outer layer of glass that is chromium-free remains after the inner layer of chromium-containing glass forms, and interrupting the cooling of the element at a temperature of about 1050° C. to thermally convert the chromium-free glass to a glass-ceramic.

14. In a method according to claim 10, the method comprising providing a furnace element of an iron-nickel-chromium alloy composed primarily of about 37% iron, 35% nickel and 27% chromium.

15. In a method according to claim 10, the method comprising coating an exposed surface on the element with a porous, dry layer of glass at least about ten microns in thickness.

16. In a method according to claim 10, the method comprising coating the exposed surface on the element with a porous, dry layer of a strontium-nickel aluminoborosilicate glass having a composition consisting essentially of in weight percent, 20–60% SrO, 30–70% $SiO_2$, $Al_2O_3$ in an amount not exceeding 15% and NiO in an amount not exceeding 25%.

17. In a method according to claim 10, the method comprising heating the coated element in a first stage in which chromium collects and is oxidized to chromium oxide, then heating the coated element in a second stage to soften a portion of the glass coating adjacent to the element and absorb the chromium oxide in that softened glass and thereafter cooling the coated element in a third stage.

18. In a method according to claim 17, the method comprising interrupting the cooling stage at a crystallizing temperature of the coating glass and holding at that temperature for atime sufficient to permit crystallization of any non-chromium oxide containing portion of the coating.

19. A metal component for a furnace used in thermally cracking or reforming hydrocarbons, the component being a chromium containing alloy and having a surface exposed to hydrocarbons during furnace operation, the exposed surface having an adherent layer of a chromium oxide containing glass on that exposed surface.

20. A furnace component in accordance with claim 19 wherein the glass layer is 5–10 microns in thickness.

21. A furnace component in accordance with claim 19 wherein the component is composed of an austenitic metal containing chromium.

22. A furnace component in accordance with claim 21 wherein the component is an alloy composed primarily of 37% Fe, 35% Ni and 27% Cr.

23. A furnace component in accordance with claim 19 wherein the glass layer on the exposed surface is a glass selected from the group consisting of alkaline earth metal silicate, alkaline earth metal aluminoborosilicate and alkaline earth metal aluminoborate glass families.

24. A furnace component in accordance with claim 23 wherein the glass layer is a barium aluminosilicate or a strontium-nickel aluminosilicate glass containing dissolved chromium oxide.

25. A furnace component in accordance with claim 24 wherein the glass is a barium aluminosilicate that, in addition to dissolved chromium oxide, consists essentially of, in percent by weight on an oxide basis, 20–65% BaO, 25–65% $SiO_2$ and $Al_2O_3$ in an amount not exceeding 15%.

26. A furnace component in accordance with claim 24 wherein the glass is a strontium-nickel aluminosilicate that, in addition to dissolved chromium oxide, consists essentially of, in weight percent on an oxide basis, 20–60% SrO, 30–70% $SiO_2$, $Al_2O_3$ in an amount not exceeding 15% and NiO in an amount not exceeding 25%.

27. A furnace component in accordance with claim 19 in the form of a reactor tube, the tube having the glass layer on its interior wall.

28. A furnace component in accordance with claim 19 in the form of a fitting, the fitting having the glass layer on at least a portion of its exposed surface.

29. A furnace component in accordance with claim 19 wherein a glass-ceramic layer overlies the layer of chromium oxide-containing glass.

* * * * *